United States Patent [19]

Kovacs

[11] Patent Number: 4,891,076

[45] Date of Patent: Jan. 2, 1990

[54] GRAY CAST IRON HAVING BOTH INCREASED WEAR RESISTANCE AND TOUGHNESS

[75] Inventor: Bela V. Kovacs, Bloomfield Hills, Mich.

[73] Assignee: Ford Motor Company, Dearborn, Mich.

[21] Appl. No.: 255,309

[22] Filed: Oct. 11, 1988

Related U.S. Application Data

[63] Continuation-in-part of Ser. No. 945,145, Dec. 22, 1986, abandoned.

[51] Int. Cl.[4] ..... C21D 5/00

[52] U.S. Cl. ..... 148/3; 148/138; 148/321; 420/15; 420/26; 420/27; 420/32

[58] Field of Search ..... 148/3, 138, 141, 321, 148/327; 420/13, 15, 26, 27, 32

[56] References Cited

U.S. PATENT DOCUMENTS

| | | | |
|---|---|---|---|
| 2,885,284 | 5/1959 | Moore | 420/28 |
| 3,384,515 | 5/1968 | Ackerman et al. | 148/2 |
| 4,230,506 | 10/1980 | Clark | 148/3 |
| 4,596,606 | 6/1986 | Kovacs et al. | 148/138 |

OTHER PUBLICATIONS

*Metals Handbook,* 9th ed., vol. 1, pp. 12–13 and 24–26, 1978.

*Primary Examiner*—Melvyn J. Andrews
*Assistant Examiner*—George Wyszomierski
*Attorney, Agent, or Firm*—Joseph W. Malleck; Roger L. May

[57] ABSTRACT

A method is disclosed for making gray iron having both increased wear resistance and impact toughness, comprising: (a) solidifying a hypoeutectic gray iron melt (i) to which has been added a eutectic carbide forming agent in an amount of 0.3–0.8% by weight, selected from the group consisting of Ti, V and Cr, and, advantageously, a high carbon austenite/ferrite forming agent in an amount of 0.5–3.0%, by weight, selected from the group consisting of nickel and copper, and at a solidification rate to form an austenite matrix with a mixture of flake graphite and eutectic carbide particles suspended in said matrix; and (b) heat treating the solid by (i) heating to a temperature and for a period of time to fully austenitize the solid, (ii) quenching the solid to a temperature level and for a period of time to decompose austenite to form a high carbon austenite and ferrite matrix, and (iii) air cooling the solid to room temperature. The hypoeutectic gray iron contains less than 4.35% carbon equivalent and preferably comprises, by weight, 2.5–2.95% carbon, 2.0–2.5% silicon, 0.5–0.90% manganese, and the remainder iron.

13 Claims, 1 Drawing Sheet

GRAY CAST IRON HAVING BOTH INCREASED WEAR RESISTANCE AND TOUGHNESS

This is a continuation in part application of U.S. Ser. No. 945,145, filed Dec. 22, 1986, now abandoned, entitled "GRAY CAST IRON HAVING BOTH INCREASED WEAR RESISTANCE AND TOUGHNESS".

BACKGROUND OF THE INVENTION

1. Technical Field

The invention relates to the art of making gray cast iron and, more particularly, to the technology involving chemistry variations and heat treating variables for improving the characteristics of wear resistance and toughness.

2. Description of the Prior Art

Gray cast iron is the least expensive of all the cast metals. This is due to the type of raw materials used: pig iron, cast iron scrap, steel scrap, limestone, coke and air, all of which are relatively inexpensive. Most gray iron used commercially is used primarily in the as-cast condition. There has been little attention given to heat treatment and low alloying for gray cast irons through the years.

The general concensus of foundry operators in this country indicates that the chemical composition of gray cast iron should be about (using weight percentages here and throughout the description, except where noted otherwise): 2.0–4.0 carbon; 1.25–3.25 silicon; 0.75–1.25 manganese; 0.08–12 sulfur; and 0.07–0.20 phosphorus. Gray cast iron will have a microstructure consisting of a pearlite matrix (aggregate of ferrite and iron carbide) and suspended graphite flakes; suspended carbides are not present and not desired. If carbides are present, the iron becomes a different type such as mottled iron or white cast iron.

In the field of scuffing wear, gray cast iron (having poor impact strength) is usually used where,the required impact toughness in service is not severe. Such cast iron is resistant to scuffing wear because of the presence of a high amount of type A flake graphite and a coarse pearlite matrix. If gray cast iron is rapidly cooled, it may contain up to 50% by volume primary complex iron carbides (cementite) dispersed in the matrix. Unfortunately, however, these primary aggregated carbides impart brittleness to the cast iron which considerably limits its usefullness with reference to impact strength. While relegating gray cast iron to applications without the need for high impact strength, the main developmental effort has been to improve machining.

One attempt to provide greater machinability while retaining wear resistance of gray cast iron involves heat treating the as-cast iron to reduce hardness while retaining the pearlite microstructure (see U.S. Pat. No. 4,230,506). In this patent, the cast metal was alloyed with a combination of carbide forming agents such as chromium and vanadium, and with pearlite stabilizers such as nickel and copper. They were used in combination to provide a composite total in an amount of 2.25–3.85%; this is a considerable amount of alloying agent producing sizable aggregated carbides. The improvement in machinability was achieved by heat treating to an austenitizing temperature, slowing cooling over a period of 1–½ hours to a temperature level of 400° F., and then air cooling. Slow cooling promoted the production of a ferritic matrix and reduced the hardness of such cast iron, making it more readily machinable. After machining, the iron was quenched to transform any retained austenite to martensite.

The problem with the '506 patent is that scuffing wear resistance may be retained at the sacrifice of toughness and strength characteristics, making it unsuitable for applications that require a high level for both of these characteristics. Without suspended carbide particles, such iron cannot offer improved abrasive wear resistance.

Similarly, in U.S. Pat. No. 3,384,515, the solution to the problem of machinability was to control heat treating to permit the promotion of complex iron carbides (aggregated cementite) while providing for incipient spheroidization of pearlite, thereby avoiding martensite and reducing the hardness of the material. The same problems remain with respect to lack of enhancement of toughness and strength characteristics and the absence of suspended carbide particles to enhance abrasive wear resistance.

In U.S. Pat. No. 2,885,284, an attempt was made to provide for an increase in both the abrasive wear as well as toughness of a variety of irons, including gray cast iron. The contribution of this patent is to incorporate high amounts of alloying ingredients in the form of aluminum and manganese to promote contrary characteristics. Aluminum is added in amounts greater than 1% to promote graphitization and manganese is added in amounts greater than 1.5% to promote carbide stabilization. There is no attempt to modify or introduce any unusual heat treating parameters; there is simply a reliance upon conventional processing and heat treating steps. This patent does not teach obtaining free or suspended carbides as a mechanism to improve abrasive wear resistance in gray cast iron (see column 3, line 22). The disclosure also admits, in column 2, lines 27–33, that the amount of aluminum or manganese that is incorporated will depend upon which characteristic is desired in the final product. To increase toughness, the carbon must be predominantly in the form of graphite promoted by the use of aluminum. To provide for increased hardness, the carbon must be predominantly in the form of carbides, which is promoted by the incorporation of manganese. This disclosure is an "either/or" teaching in that there is no suggestion that both of such characteristics can be achieved at a high level at the same time.

It is an object of this invention to provide a gray cast iron having both increased wear resistance and toughness which can be achieved by modification both in the chemistry and the heat treating techniques for gray cast iron.

It is another object to produce a gray cast iron which has a stronger matrix to retain and hold suspended graphite and carbides in a gray cast iron.

In addition, it is an object of this invention to provide the above type of gray cast iron which additionally has high tensile strength, high damping capacity, high heat conductivity, and more ductility than conventional cast irons.

SUMMARY OF THE INVENTION

The above objects have been achieved by development of chemistry and process controls which disperse a predetermined mixture of eutectic carbide particles and flake graphite throughout a matrix of high carbon austenite and ferrite.

The invention specifically is a method comprising: (a) solidifying a hypoeutectic gray iron melt (i) to which has been added a eutectic carbide forming agent in an amount of 0.3–0.8% by weight, selected from the group consisting of Ti, V and Cr, and, advantageously, a high carbon austenite/ferrite forming agent in an amount of 0.5–3.0% by weight (i.e., nickel and copper), and (ii) at a solidification rate to form a matrix with a mixture of flake graphite and eutectic carbide suspended in an pearlite matrix; and (b) heat treating the solid by (i) heating to a temperature and for a period of time to fully austenitize the solid, and (ii) quenching the solid to a temperature level and for a period of time to decompose austenite to form a high carbon austenite and ferrite matrix.

The hypoeutectic gray iron contains less than 4.35% carbon equivalent and comprises, by weight, 2.5–2.95% carbon, 2.0–2.5% silicon, 0.5–0.90% manganese, and the remainder iron.

Preferably, the heat treating comprises heating to a temperature level of 1560°–1750° F. for a period of time of 1.5–4.0 hours, and the quenching step comprises quenching to a temperature level of 450°–800° F. for a period of time of 1.5–6.0 hours. The rate at which such quenching is carried out is preferably in the range of 300°–375° F. per minute.

The resultant cast iron will comprise a microstructure having the suspended mixture comprised of 40–60% flake graphite and the remainder of the mixture eutectic carbide particles. Such mixture is controlled by the selection of the solidification rate and by the selection of chemistry for the gray cast iron melt. The casting will preferably have a tensile strength of 45–55 ksi, an impact strength of 30–35 ft/lb, and an elongation of about 2%. The wear resistance of such casting is 2–3 times greater than conventional gray cast irons, and when measured by a standard sleeve test, is 0.0028–0.0019 inch per 1000 hours. The casting also is characterized by resistance to scuffing whereby the ratio of horsepower to produce scuffing divided by the normal horsepower is greater than 1.5. These wear resistance parameters are achieved through attainment of a type A graphite flake mixed with eutectic carbide in the casting.

DETAILED DESCRIPTION AND BEST MODE

Figure 1:
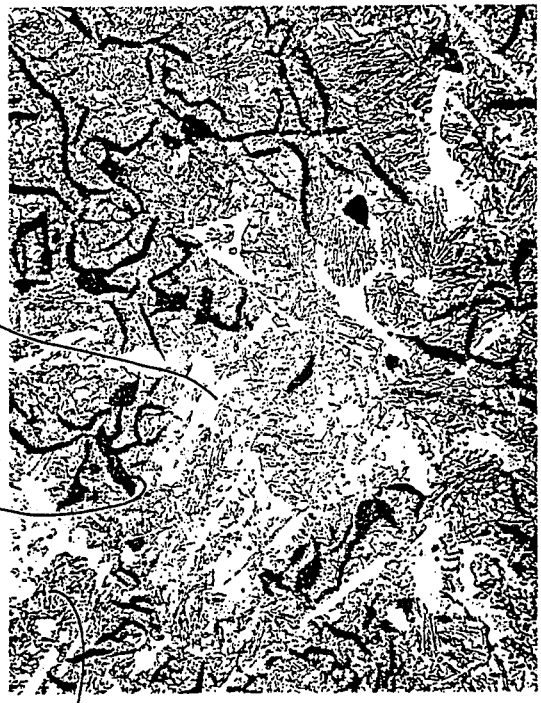
FIG. 1 is a photo-micrograph of the structure of the casting produced by the method of this invention, the microstructure being shown at an enlargement of 500X. Areas of flake graphite, eutectic carbide, and austenite/ferrite are indicated.

The preferred method for making a gray cast iron having both increased wear resistance and impact toughness comprises: (a) solidifying a hypoeutectic gray iron melt (i) to which has been added a eutectic carbide forming first agent in an amount of 0.3–0.8% by weight, selected from the group consisting of titanium, vanadium and chromium, and a second agent to facilitate the formation of high carbon austenite/ferrite, said second agent being present in an amount of 0.5–3.0% by weight, selected from the group consisting of nickel and copper, and (ii) at a solidification rate to form a matrix with a mixture of flake graphite and eutectic carbide particles suspended in an austenite matrix; and (b) heat treating the solid by (i) heating to a temperature and for a predetermined period of time to fully austenitize the solid, (ii) quenching the solid to a temperature level and for a period of time to decompose austenite to form a high carbon austenite/ferrite matrix, and (iii) air cooling the solid.

Chemistry

A conventional wear resistant gray iron usually contains 3.0–4.0% carbon, 1.5–3.0% silicon, and 0.5–0.9% manganese. This method lowers the carbon content and adds both a eutectic carbide forming agent and an agent to facilitate the formation of high carbon austenite/ferrite during heat treatment. Eutectic carbides are formed during solidification and are platelet in configuration. The carbide forming agent is made in addition to the normal carbide forming tendencies of manganese which is a normal part of gray cast iron. Mn and Mo are weak eutectic carbide formers; Mo forms the wrong shape for a carbide particle being a large number of small, round particles rather than larger platelets. Aluminum is specifically absent from the present chemistry because it is a graphitizer which works against carbide formation and encourages pin-hole defects. The addition of a graphitizing agent is conspicuously absent from the present invention because graphitization can be controlled through process parameters with a given lower amount of carbon.

Specifically, the chemistry comprises, preferably, 2.5–2.95% by weight carbon (a hypoeutectic iron/carbon alloy would comprise less than 4.35% carbon equivalent). If the carbon content were to be below 2.5%, it would be difficult to provide the desired amount of carbide/graphite ratio (40:60 to 60:40) that is necessary for both the wear resistance and the impact strength of this invention. If the carbon content were in excess of 2.95%, processing parameters would tend to form an excessive amount of graphite. The lower carbon content, compared to a conventional gray cast iron, promotes the formation of eutectic carbides. In the hypoeutectic melt, the metal will freeze first, increasing the carbon content of the remaining liquid and promoting eutectic carbide formation. It is desirable for the starting melt for this invention that it have a carbon equivalent in the range of 3.2–4.35, because below 3.2, too much carbide is formed, and above 4.35, too much graphite is formed, making it difficult to control the graphite/carbide ratio. Silicon is present in an amount of 2.0–2.5% and manganese remains at 0.5–0.9%. The lower silicon and slightly higher manganese, compared to conventional gray cast iron and the addition of the carbide forming agent, facilitates eutectic carbide formation. If the silicon and manganese contents were to be below the designated amounts of 2.0 and 0.5%, respectively, there would be insufficient volumes of graphite or eutectic carbide formation. If the upper limit of manganese was exceeded, Mn egregation will occur and a nonuniform matrix structure will result. If the upper limit of silicon is exceeded, the eutectic carbide formation is inhibited and only graphite formation will occur.

The additional eutectic carbide forming agent, which is added to the gray iron melt herein, comprises titanium, chromium or vanadium. Any one or all of these ingredients may be added as long as they are present in the alloy melt in an amount in the range of 0.3–0.8% as combined. If less than 0.3% is employed, the eutectic carbide volume will be too low; if greater than 0.8% is employed, then too much carbide will be present.

In order to promote the decomposition of austenite into high carbon austenite and ferrite, without the formation of pearlite, bainite or martensite, during the heat treatment and cooling sequence, it is desirable to add either nickel and/or copper in an amount of 0.5–3.0%, which functions as a pearlite suppressor and thus an austenite/ferrite former. If the amount of these elements, singly or combined, were to be below 0.5%, then pearlite formation in larger castings will occur,and if exceeding 3.0%, the alloying agent would be wasted and is uneconomical.

The above melt is fully solidified at a rate over a period of 4–16 minutes to ensure the formation of a carbon mixture in the form of 40–60% by volume graphite and the remainder eutectic carbide.

Processing

The solidification of the melt, as indicated above, is then subjected to a heat treatment sequence which comprises heating to an austenitizing temperature in the range of 1560°–1750° F. (848.9°–865.2° C.) and held at such temperature for a period of 1.5–4.0 hours, during which time the casting will be fully austenitized. The casting is then quenched to a temperature level of 450°–800° F. and held for a period of 1.5–6.0 hours. The quench rate whould be in the range of 300°–375° F. per minute. If the quench rate were to be slower than 300° F. per minute, the opportunity for formation of pearlite would be increased. If the quench rate were to exceed 375° F. per minute, the tendency for forming quenching cracks (due to high thermal stresses) would be experienced. The quench rate is important because it attempts, by way of processing, to determine the desirable matrix of austenite and ferrite. By observing the quench rate and the required chemistry, such heat treatment sequence will result in a cast iron matrix of austenite/ferrite having a suspended carbon mixture in the form of 40–60% flake graphite and the remainder of the mixture in the form of eutectic carbide particles. This proportioned mixture is one of the key aspects of providing for simultaneous enhancement of wear resistance and impact resistance.

Following the decomposition of austenite to high carbon austenite and ferrite, the casting or solidification is then cooled to room temperature by air cooling.

Microstructure

The resulting casting will have a microstructure which consists of a igh carbon austenite and ferrite matrix (about 65% ferrite and about 35% austenite) with a suspended mixture of flake graphite and eutectic carbide particles. There is a conspicuous absence of martensite, bainite or pearlite in the microstructure. The suspended mixture particles constitute about 20% by volume of the microstructure. The graphite particles will be in the form of type A flake graphite because of good inoculation using ferro-silicon. Such type A graphite will influence the damping capacity, thermal conductivity, and machinability of the gray cast iron.

The physical characteristics of such gray cast iron will have a wear resistance which is at least 2–3 times greater than that of conventional gray cast irons, and with the limited samples that have been tested to date the wear resistance, shows 0.0028–0.0019 inch per 1000 hours of a conventional sleeve test (which is primarily an abrasive wear phenomenon), such test being outlined in the *Metals Handbook.*

In addition, the wear resistance is characterized by resistance to scuffing (which is primarily a welding wear phenomenon, wherein the ratio of horsepower is greater than 1.5. Gray cast iron, having a type A graphite in a martensite matrix, normally exhibits a resistance to scuffing in the range of 1.39–1.45.

The presence of increasing ferrite in the matrix of a gray cast iron has often been associated with poorer wear resistance and lower hardness values (see *Metals Handbook*). With this invention, the opposite has occurred.

The impact resistance was tested to be in the range of 2–5 ft/lbs, where a conventional gray cast iron has a charpy notched impact value normally in the range of 1–2 ft/lbs.

The tensile strength of such resultant cast iron is 45–55 ksi, which is in the high range for gray cast iron, and elongation of about 1–2%. The hardness for such material is in the range of 320–480 BHN.

Examples

Several examples were prepared by melting a gray iron starting material which consisted of silicon in an amount of 2.3%, manganese 6%, with phosphorus being 0.012%, and sulphur being 0.001%. The carbon content of the gray iron was varied according to that shown in Table I along with variations in the added carbide forming agent, and variations in the addition of nickel as an agent to encourage the decomposition of austenite to high carbon austenite and ferrite. Heat treatment was employed as indicated (such treatment being to heat the casting to 1570° F. for two hours, quench to 600° F., hold for two hours, then air cool). The wear resistance and impact resistance were recorded for each such example.

While various examples of the invention have been illustrated and described, it will be obvious to those skilled in the art that various changes and modifications may be made without departing from the invention, and it is intended to cover in the appended claims all such changes and equivalents as fall within the true spirit and scope of the invention.

TABLE I

| Sample | Carbon Content (Wt. %) | Carbide Former Additive (Wt. %) | Austenite/ Ferrite Promoter (Wt. %) | Heat Treatment Applied | Wear Resistance | Impact Resistance* (ft/lbs) |
|---|---|---|---|---|---|---|
| 1 | 3.5 | None | None | No | Poor | 2 |
| 2 | 3.0 | Ti/.5 | " | Yes | Poor (excessive graphite) | 1.5 |
| 3 | " | " | Ni/2.0 | " | Poor (excesive graphite) | 6.0 |
| 4 | 2.90 | Ti/.5 | " | " | Good | 5.0 |
| 5 | " | Cr/.5 | " | " | " | 4.5 |
| 6 | " | V/.5 | " | " | Very Good | 4.0 |
| 7 | " | Mo/.5 | " | " | Good | 1 (damping very low martensite formed) |

TABLE I-continued

| Sample | Carbon Content (Wt. %) | Carbide Former Additive (Wt. %) | Austenite/ Ferrite Promoter (Wt. %) | Heat Treatment Applied | Wear Resistance | Impact Resistance* (ft/lbs) |
|---|---|---|---|---|---|---|
| 8 | 2.90 | Ti/.1 | " | " | Poor | 2 |
| 9 | " | V/.1 | None | " | Poor | 3 |
| 10. | 2.5 | Ti/.3 | Ni/2.0 | " | Good | 3 |
| 11. | 2.3 | V/.3 | " | " | Good | 4 |
| 12. | 2.90 | V/1.5 | " | " | Good | 1 |

*Notched charpy samples

What is claimed:

1. A method of making a more wear resistant gray cast iron with high impact strength, comprising:

(a) solidifying a hypoeutectic gray iron melt to which has been added a eutectic carbide forming agent in an amount of 0.3–0.8% by weight, selected from the group consisting of titanium, vanadium and chromium, and a high carbon austenite/ferrite forming agent in an amount of 0.5–3.0% by weight, said solidification being at a rate to form an austenite matrix with a mixture of flake graphite and eutectic carbide suspended in said matrix; and (b) heat treating said solid by (i) heating to a temperature and for a period of time to fully austenitize the solid, (ii) quenching said solid to an austenite decomposition temperature level and holding at said level for a period of time to decompose austenite to form essentially a high carbon austenite and ferrite matrix with said suspended mixture comprised of 40–60% flake graphite and remainder of the mixture being eutectic carbide particles, and (iii) air cooling the solid to room temperature.

2. The method as in claim 1, in which said high carbon austenite/ferrite forming agent is selected from the group consisting of nickel and copper.

3. The method as in claim 1, in which said hypoeutectic gray iron melt comprises, by weight, 2.5–3.0% carbon, 2.0–2.5% silicon, 0.5–0.9% manganese, and the remainder iron.

4. The method as in claim 1, in which step (b)(i) comprises heating to 1560°–1750° F. for 1.5–4.0 hours.

5. The method as in claim 1, in which step (b)(ii) comprises quenching to a temperature level of 450°–800° F. for 1.5–6.0 hours.

6. The method as in claim 5, in which said quench rate is 300°–375° F./minute.

7. The method as in claim 1, in which step (b) forms a gray cast iron devoid of pearlite, bainite or martensite.

8. The product resulting from the practice of the method of claim 1, which is characterized by a tensile strength of 40–50 ksi, and an impact strength of 2–5 ft/lbs (charpy V-notched).

9. The product as in claim 8, in which said wear resistance is 0.0019–0.0028 inch per 1000 hours of sleeve test.

10. The product as in claim 8, in which the graphite for said product is of the flake type A form.

11. The product as in claim 8, in which the matrix formed by step (b) is comprised of about 65% ferrite and 35% austenite.

12. The product as in claim 8, in which the suspended mixture comprises about 20% of the gray cast iron.

13. A method of making gray cast iron with high wear resistance and impact strength, comprising:

(a) solidifying a gray iron melt having less than 3.0% carbon and to which has been added (i) a carbide forming first agent in an amount of 0.3–0.8% by weight, selected from the group consisting of titanium, vanadium and chromium, and (ii) a high carbon austenite/ferrite forming agent in an amount of 0.5–3.0%, selected from the group consisting of nickel and copper, said solidification being at a rate to form an austenite matrix with a mixture of flake graphite and eutectic carbide suspended in said matrix; and (b) heat treating said solid by (i) heating to a temperature and for a period of time to fully austenitize the solid, (ii) quenching said solid to an austenite decomposition temperature level and holding at said level for a period of time to decompose austenite to form essentially a high carbon austenite and ferrite matrix carrying in suspension a mixture of 40–60% flake graphite and the remainder eutectic carbide particles, and (iii) air cooling the solid to room temperature.

* * * * *